US009790796B2

(12) United States Patent
Stampfli et al.

(10) Patent No.: US 9,790,796 B2
(45) Date of Patent: Oct. 17, 2017

(54) SYSTEMS AND METHODS FOR MODIFYING A PRESSURE SIDE ON AN AIRFOIL ABOUT A TRAILING EDGE

(71) Applicant: General Electric Company, Schenectady, NY (US)

(72) Inventors: John David Stampfli, Greer, SC (US); Ajay Keshava Rao, Bangalore (IN); Rudolf Konrad Selmeier, Fahrenzhausen (DE)

(73) Assignee: General Electric Company, Schenectady, NY (US)

( * ) Notice: Subject to any disclaimer, the term of this patent is extended or adjusted under 35 U.S.C. 154(b) by 1064 days.

(21) Appl. No.: 14/031,206

(22) Filed: Sep. 19, 2013

(65) Prior Publication Data

US 2015/0075179 A1 Mar. 19, 2015

(51) Int. Cl.
*F01D 5/14* (2006.01)

(52) U.S. Cl.
CPC ..... *F01D 5/14* (2013.01); *F01D 5/141* (2013.01); *F05D 2250/712* (2013.01); *F05D 2250/713* (2013.01)

(58) Field of Classification Search
CPC ..... F01D 5/14; F01D 5/141; F05D 2250/712; F05D 2250/713
See application file for complete search history.

(56) References Cited

U.S. PATENT DOCUMENTS 5,151,014 A * 9/1992 Greenwald ..... B64C 3/58 416/237
5,588,804 A * 12/1996 Neely ..... F04D 29/384 416/223 R
8,186,616 B2 * 5/2012 Shepshelovich ..... B64C 3/14 244/35 R
2010/0296924 A1 * 11/2010 Boning ..... F01D 5/141 415/208.1
2011/0206527 A1 8/2011 Harvey et al.
2012/0230834 A1 * 9/2012 Cornelius ..... F01D 5/141 416/243

FOREIGN PATENT DOCUMENTS

EP 2360377 A2 8/2011

* cited by examiner

*Primary Examiner* — Dwayne J White
*Assistant Examiner* — Adam W Brown
(74) *Attorney, Agent, or Firm* — Eversheds Sutherland (US) LLP

(57) ABSTRACT

An airfoil is disclosed herein. The airfoil may include a leading edge, a trailing edge, a suction side defined between the leading edge and the trailing edge, and a pressure side defined between the leading edge and the trailing edge opposite the suction side. The pressure side may include a concave profile about the trailing edge that varies from a profile of a remainder of the pressure side.

1 Claim, 4 Drawing Sheets

SYSTEMS AND METHODS FOR MODIFYING A PRESSURE SIDE ON AN AIRFOIL ABOUT A TRAILING EDGE

FIELD

Embodiments of the disclosure relate generally to an axial compressor of a gas turbine engine and more particularly relate to systems and methods for modifying a pressure side of an airfoil about a trailing edge to increase the effective camber of the airfoil without modifying a suction side thereof.

BACKGROUND

During operation of a gas turbine engine, air is continuously induced into an axial compressor. In order to reduce the foot print of the axial compressor, the airfoils within the axial compressor must create greater lift. Increasing the lift of an airfoil will produce greater turning of the flow. The more turning the airfoils can produce, the fewer stages that may be required.

BRIEF DESCRIPTION

Some or all of the above needs and/or problems may be addressed by certain embodiments of the disclosure. According to one embodiment, there is disclosed an airfoil. The airfoil may include a leading edge, a trailing edge, a suction side defined between the leading edge and the trailing edge, and a pressure side defined between the leading edge and the trailing edge opposite the suction side. The pressure side may include a concave profile about the trailing edge that varies from a profile of a remainder of the pressure side.

According to another embodiment, there is disclosed a gas turbine engine system. The system may include a compressor having a number of airfoils. Each of the airfoils may include a leading edge, a trailing edge, a suction side defined between the leading edge and the trailing edge, and a pressure side defined between the leading edge and the trailing edge opposite the suction side. The pressure side may include a concave profile about the trailing edge that varies from a profile of a remainder of the pressure side. A combustor may be in communication with the compressor. Moreover, a turbine may be in communication with the combustor.

Further, according to another embodiment, there is disclosed a method for improved flow turning and lift in an axial compressor. The method may include providing an airfoil having a leading edge, a trailing edge, a suction side defined between the leading edge and the trailing edge, and a pressure side defined between the leading edge and the trailing edge opposite the suction side. Moreover, the method may include modifying the pressure side about the trailing edge to increase an effective camber of the airfoil without modifying the suction side.

Other embodiments, aspects, and features of the invention will become apparent to those skilled in the art from the following detailed description, the accompanying drawings, and the appended claims.

BRIEF DESCRIPTION OF THE DRAWINGS

Reference will now be made to the accompanying drawings, which are not necessarily drawn to scale.

DETAILED DESCRIPTION

Illustrative embodiments will now be described more fully hereinafter with reference to the accompanying drawings, in which some, but not all embodiments are shown. The disclosure may be embodied in many different forms and should not be construed as limited to the embodiments set forth herein. Like numbers refer to like elements throughout.

Illustrative embodiments of the disclosure are directed to, among other things, systems and methods for modifying a pressure side of an airfoil about a trailing edge to increase the effective camber of the airfoil. In some instances, the airfoil may be incorporated in an axial compressor of a gas turbine engine or the like. In certain embodiments, a number of airfoils may be used. For example, a number of airfoils may be radially spaced apart about a rotor of an axial compressor to form a stage therein. The airfoils may form a first stage, a last stage, or any stage therebetween.

The airfoil may include a leading edge, a trailing edge, a suction side defined between the leading edge and the trailing edge, and a pressure side defined between the leading edge and the trailing edge opposite the suction side. In some instances, the pressure side of the airfoil may be modified about the trailing edge to increase the effective camber of the airfoil without modifying the suction side. For example, the pressure side may include a concave profile about the trailing edge. The concave profile about the trialing edge of the pressure side may vary from a profile of a remainder of the pressure side. In some instances, the concave profile may be configured to modify a thickness distribution about the trailing edge without modifying the suction side. The reduced thickness of the trailing edge resulting from the concave profile on the pressure side of the trailing edge may increase the trailing edge effective camber without modifying the suction side, resulting in lower losses at higher angles of incidence, better turning of the air flow in the compressor at design incidence angles, and better turning of the air flow in the compressor for both positive and negative inlet flow incidence angles. This may enable higher stage loads, which can lead to shorter compressor designs.

Figure 1:
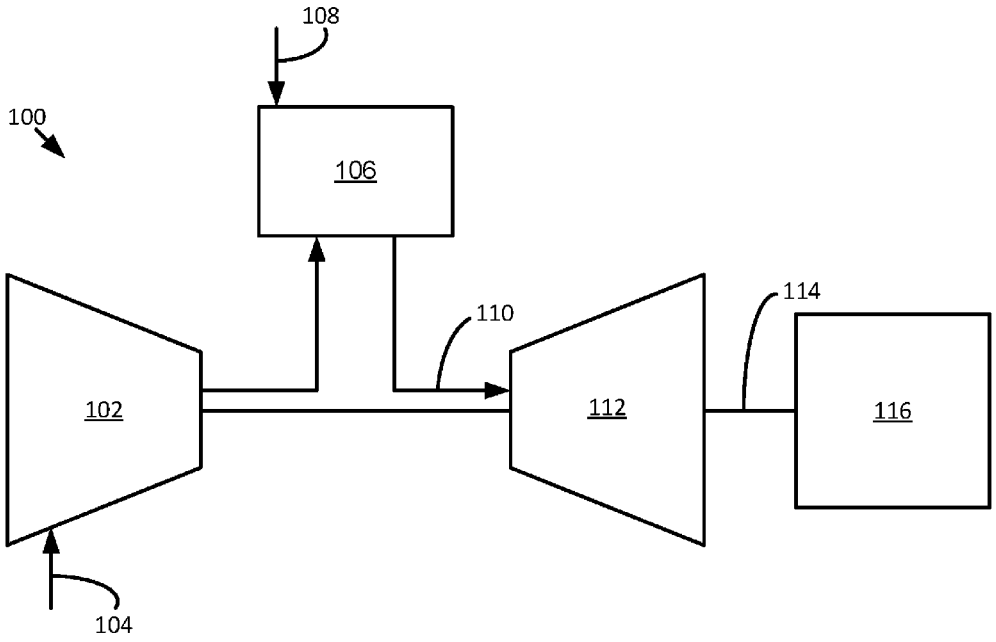
FIG. 1 (Prior Art)
FIG. 1 schematically depicts an example view of a gas turbine engine.

Turning now to the drawings, FIG. 1 shows a schematic view of gas turbine engine 100 as may be used herein. The gas turbine engine 100 may include a compressor 102. The compressor 102 compresses an incoming flow of air 104. The compressor 102 delivers the compressed flow of air 104 to a combustor 106. The combustor 106 mixes the compressed flow of air 104 with a compressed flow of fuel 108 and ignites the mixture to create a flow of combustion gases 110. Although only a single combustor 106 is shown, the gas turbine engine 100 may include any number of combustors 106. The flow of combustion gases 110 is in turn delivered to a downstream turbine 112. The flow of combustion gases 110 drives the turbine 112 to produce mechanical work. The mechanical work produced in the turbine 112 drives the compressor 102 via a shaft 114 and an external load 116, such as an electrical generator or the like.

The gas turbine engine 100 may use natural gas, various types of syngas, and/or other types of fuels. The gas turbine engine 100 may be anyone of a number of different gas turbine engines such as those offered by General Electric Company of Schenectady, N.Y. and the like. The gas turbine engine 100 may have different configurations and may use other types of components. Other types of gas turbine engines also may be used herein. Multiple gas turbine engines, other types of turbines, and other types of power generation equipment also may be used herein together.

Figure 2:
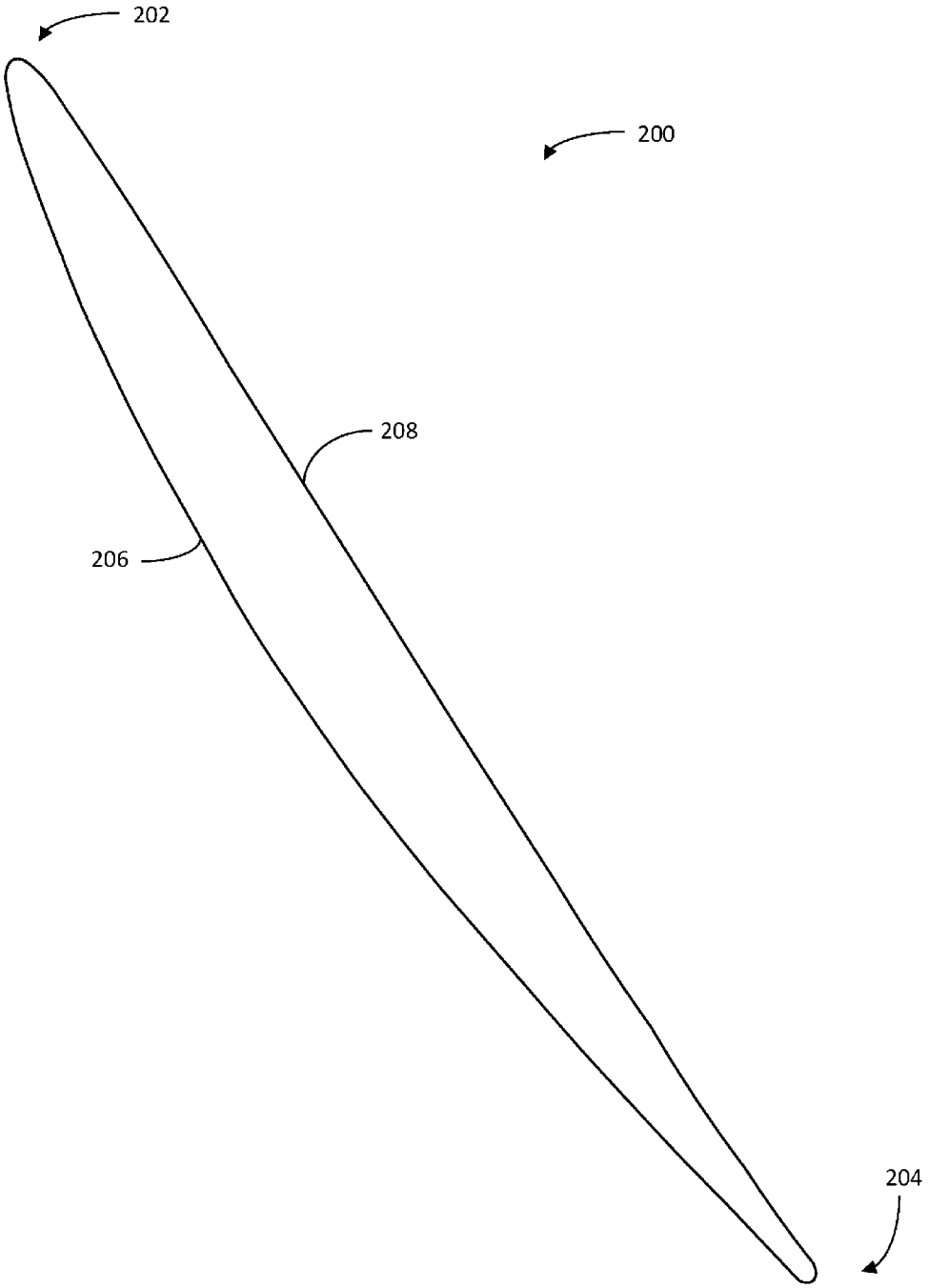
FIG. 2 (Prior Art)
FIG. 2 schematically depicts an example cross-sectional view of an airfoil.

FIG. 2 schematically depicts one example embodiment of a known airfoil 200. The airfoil 200 may be incorporated into the compressor 102 of FIG. 1. The airfoil 200 may include a leading edge 202, a trailing edge 204, a suction side 206 defined between the leading edge 202 and the trailing edge 204, and a pressure side 208 defined between the leading edge 202 and the trailing edge 204 opposite the suction side 206. The airfoil 200 also may include a cord length between the leading edge 202 and the trailing edge 204. The cord length is a straight line joining the leading edge 202 and trailing edge 204 of the airfoil 200. Further, the airfoil 200 may include a camber line. The camber line is the curve that is formed halfway between the suction side 206 and the pressure side 208 of the airfoil 200.

Figure 3:
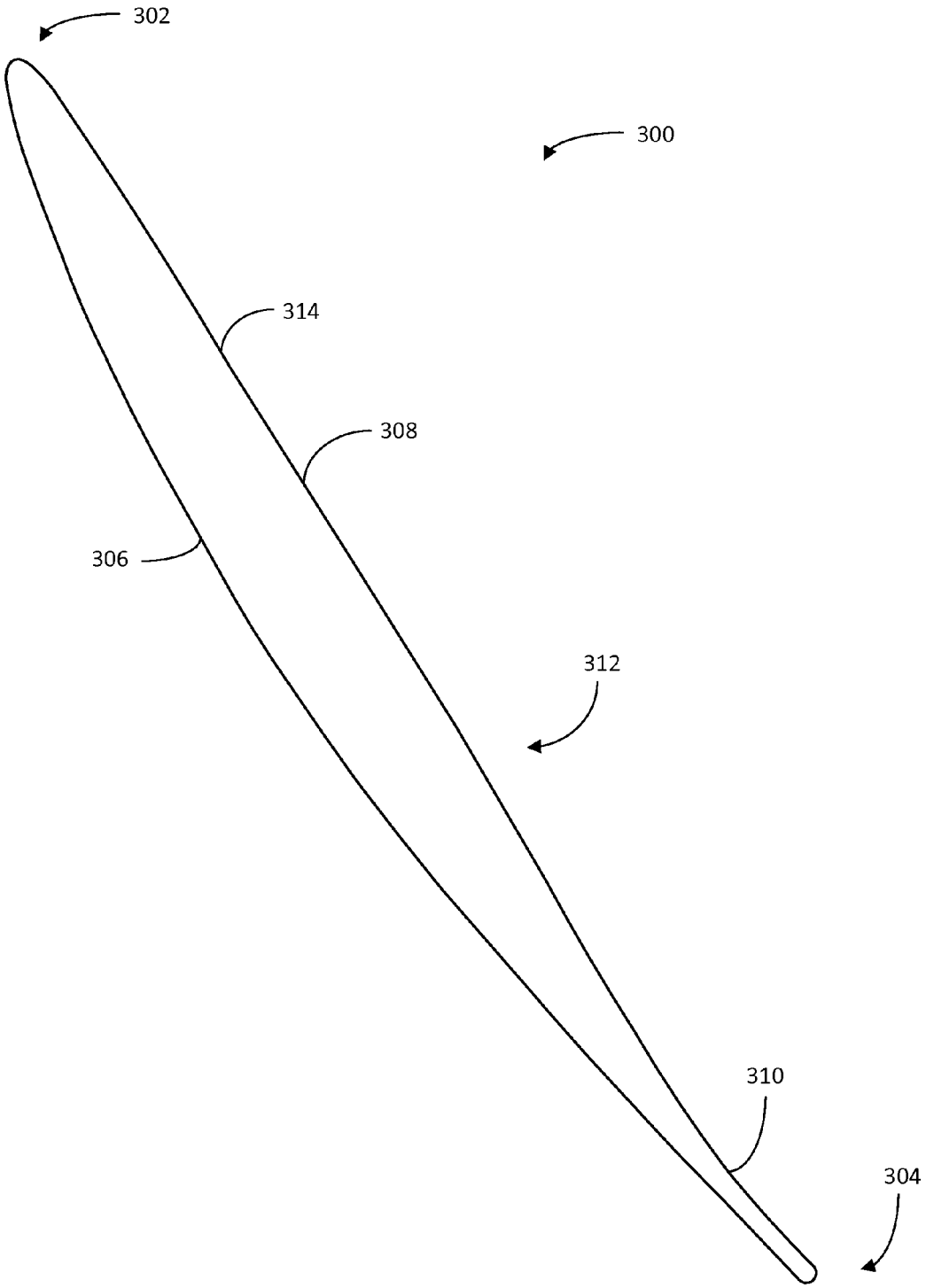
FIG. 3 schematically depicts an example cross-sectional view of an airfoil, according to an embodiment of the disclosure.

FIG. 3 schematically depicts one example embodiment of an airfoil 300 according to an embodiment of the disclosure. The airfoil 300 may be incorporated into the compressor 102 of FIG. 1. The airfoil 300 may include a leading edge 302, a trailing edge 304, a suction side 306 defined between the leading edge 302 and the trailing edge 304, and a pressure side 308 defined between the leading edge 302 and the trailing edge 304 opposite the suction side 306. The airfoil also may include a cord length between the leading edge 302 and the trailing edge 304. The cord length is a straight line joining the leading edge 302 and trailing edge 304 of the airfoil 300. Further, the airfoil 300 may include a camber line. The camber line is the curve that is formed halfway between the suction side 306 and the pressure side 308 of the airfoil 300.

Still referring to FIG. 3, in some instances, the pressure side 308 of the airfoil 300 may be modified near the trailing edge 304 to increase the camber line of the airfoil 300 without modifying the suction side 306. For example, the pressure side 308 may include a concave profile 310 near the trailing edge 304. In some instances, the concave profile 310 may be configured to modify a thickness of the trailing edge 304 without modifying the suction side 306 of the airfoil 300. For example, the concave profile 310 may decrease the thickness of the trailing edge 304 without modifying the suction side 306 of the airfoil 300. Further, the concave profile 310 may be configured to modify the camber line of the airfoil 300 without modifying the suction side 306 of the airfoil 300. For example, the concave profile 310 may be configured to increase the effective camber line of the airfoil 300 without modifying the suction side 306 of the airfoil 300. In this manner, the suction side 306 of the airfoil 300 may be substantially identical to the suction side 206 of the airfoil 200.

The pressure side 308 may include a transition point 312 between the concave profile 310 and the remainder of the pressure side 308. In this manner, the concave profile 310 may differ from the profile 314 of the remainder of the pressure side 308. In some instances, the remainder of the pressure side may include a second concave profile about the leading edge 302, a convex profile about the leading edge 302, or a combination thereof. In certain embodiments, the suction side 306 may include a convex profile, a convex profile, or a combination thereof between the leading edge 302 and the trailing edge 304.

Figure 4:
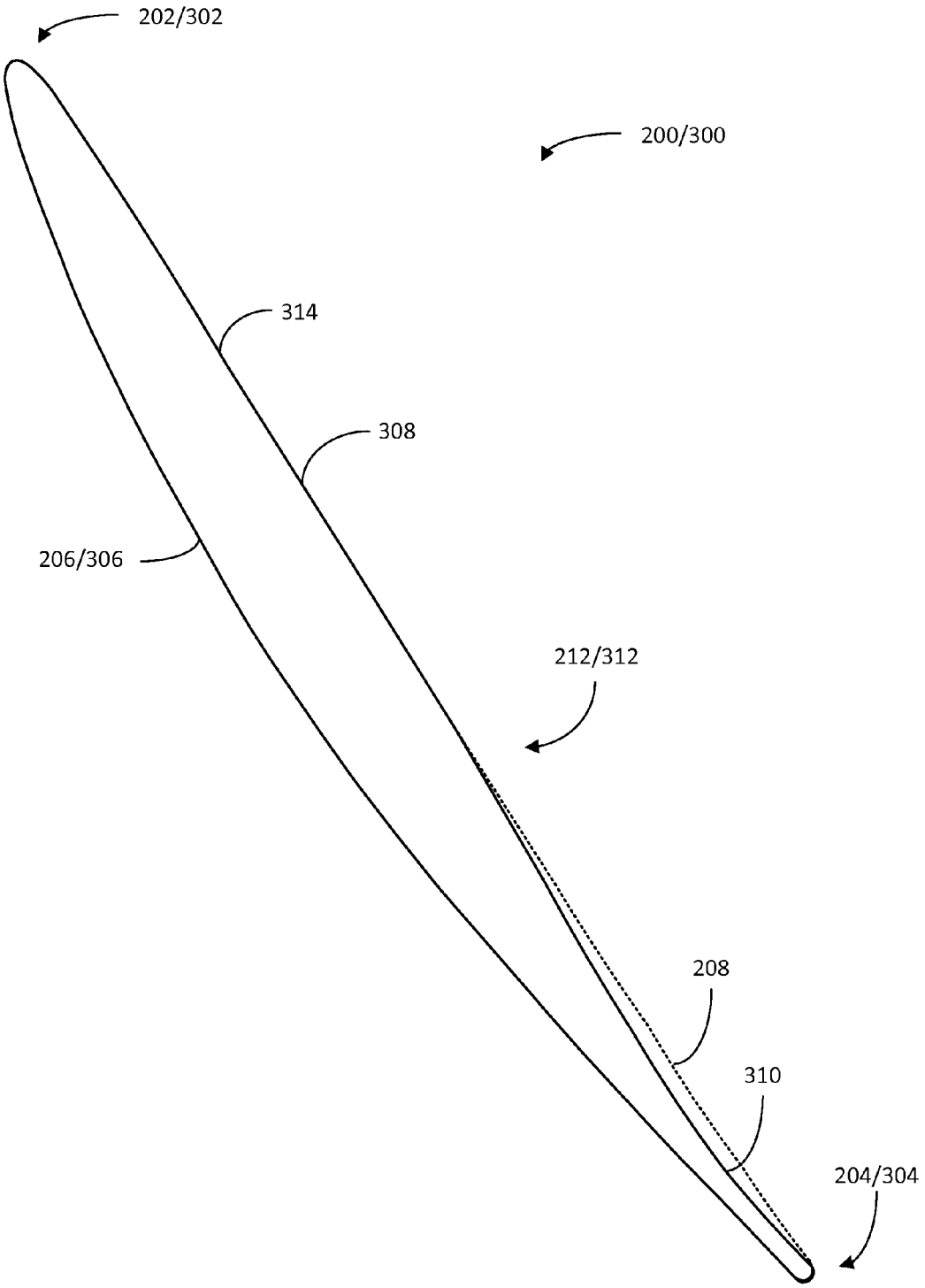
FIG. 4 schematically depicts an example cross-sectional view of the airfoils of FIGS. 2 and 3 overlapping each other.

To better illustrate the differences between the trailing edge 204 of the airfoil 200 and the trailing edge 304 of the airfoil 300, FIG. 4 depicts the airfoil 300 overlapping the airfoil 200. In particular, the pressure side 208 of the trailing edge 204 of the airfoil 200 is depicted as a dotted line. The concave profile 310 modifies the thickness of the trailing edge 304 without modifying the suction side 306 of the airfoil 300. The reduced thickness of the trailing edge 304 resulting from the concave profile 310 on the pressure side 308 of the trailing edge 304 may increase the trailing edge effective camber, resulting in lower losses at higher angles of incidence, better turning of the compressor flow at design incidence angles, and better turning of the compressor flow for both positive and negative inlet flow incidence angles. This may enable higher stage loads, which can lead to shorter compressor designs.

By modifying the pressure side 308 about the trailing edge 304, the airfoil 300 may provide more turning of the air flow in the compressor in comparison to the airfoil 200. Moreover, the airfoil 300 may provide more uniform loading as compared to the airfoil 200. In order to reduce the foot print of an axial compressor, the airfoils must turn more air flow in the compressor. The airfoil 300 can turn the air flow in the compressor by about 2 degrees or so more than the airfoil 200. Incorporation of the airfoil 300 in an axial compressor could reduce a stage, resulting in a reduction of the axial compressor length.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments.

That which is claimed:

1. A method for improved flow turning and lift in an axial compressor, comprising:

starting with an airfoil as depicted in FIG. 2, wherein the airfoil comprising a leading edge, a trailing edge, a suction side defined between the leading edge and the trailing edge, and a pressure side defined between the leading edge and the trailing edge opposite the suction side; and modifying the pressure side about the trailing edge to from a concave profile about the trailing edge that varies from a profile of a remainder of the pressure side as denoted by a transition point without modifying the suction side, which modifies a thickness distribution about the trailing edge, which in turn modifies an effective camber of the airfoil to increase an effective camber of the airfoil without modifying the suction side.

* * * * *